US012490849B2

(12) United States Patent
Cheng

(10) Patent No.: US 12,490,849 B2
(45) Date of Patent: Dec. 9, 2025

(54) STATIC EQUILIBRIUM ADJUSTING SYSTEM AND METHOD

(71) Applicant: KUONAO CO., LTD., New Taipei (TW)

(72) Inventor: Meili Cheng, New Taipei (TW)

(73) Assignee: KUONAO CO., LTD., New Taipei (TW)

( * ) Notice: Subject to any disclaimer, the term of this patent is extended or adjusted under 35 U.S.C. 154(b) by 277 days.

(21) Appl. No.: 18/258,328

(22) PCT Filed: Dec. 22, 2021

(86) PCT No.: PCT/CN2021/140386

§ 371 (c)(1),
(2) Date: Jun. 20, 2023

(87) PCT Pub. No.: WO2022/135456

PCT Pub. Date: Jun. 30, 2022

(65) Prior Publication Data

US 2024/0298823 A1 Sep. 12, 2024

(30) Foreign Application Priority Data

Dec. 25, 2020 (CN) ..... 202011560261.0

(51) Int. Cl.
*A47G 9/10* (2006.01)

(52) U.S. Cl.
CPC ..... *A47G 9/1027* (2013.01); *A47G 9/1081* (2013.01); *A47G 2009/1018* (2013.01)

(58) Field of Classification Search
CPC ..... A47G 9/1027; A47G 9/1081; A47G 2009/1018; A47G 2009/003; A47G 9/10;
(Continued)

(56) References Cited

U.S. PATENT DOCUMENTS 4,579,141 A * 4/1986 Arff ..... B63C 9/24 251/86
7,412,738 B2 * 8/2008 Chaffee ..... A47C 20/027 5/655.3

(Continued)

FOREIGN PATENT DOCUMENTS

CN 106724362 A * 5/2017
CN 207870650 U * 9/2018 ..... A47C 27/081
TW 201242530 A * 11/2012

*Primary Examiner* — David R Hare
*Assistant Examiner* — George Samuel Gines
(74) *Attorney, Agent, or Firm* — Leong C. Lei

(57) ABSTRACT

A static equilibrium adjusting system includes a bladder (10) and a regulation valve (20). An elastic restoration device (11) is arranged in the bladder (10) to support an external pressing force. The regulation valve (20) is in communication with the bladder (10) to provide an adjustable reverse-resisting force to resist an air pressure generated, in a direction toward the regulation valve (20), by the bladder (10). Through selection of a size of the interior space of the bladder (10) and a density and an elastic property of the elastic restoration device (11), a rebounding force is generated to cooperate with the reverse-resisting force generated by the regulation valve (20) to provide a supporting force to the bladder (10), so that an effect of static equilibrium is achieved among the external pressing force, the bladder (10), and the regulation valve (20).

8 Claims, 11 Drawing Sheets

(58) Field of Classification Search
CPC ..... A47C 27/084; A47C 27/088; A47C 27/10; A47C 27/083; A47C 27/08; F16K 15/20
USPC ..... 5/655.3
See application file for complete search history.

(56) References Cited

U.S. PATENT DOCUMENTS

| | | | | |
|---|---|---|---|---|
| 2016/0242562 | A1* | 8/2016 | Karschnik | A47C 27/082 |
| 2018/0332983 | A1* | 11/2018 | Son | A47G 9/1027 |
| 2019/0307259 | A1* | 10/2019 | Keesaer | A47C 27/10 |

* cited by examiner

STATIC EQUILIBRIUM ADJUSTING SYSTEM AND METHOD

TECHNICAL FIELD OF THE INVENTION

The present invention relates to an adjusting system and method, and more particularly to a static equilibrium adjusting system and method of a field of bladder technology.

DESCRIPTION OF THE PRIOR ART

Air sacs and air mats that are generally air-inflatable and deflatable are commonly used in a variety of fields of merchandise, such as seat cushions, pillows, and bed mattresses and is structurally connected with a valve, so that through opening and closing of an opening of an air compartment inside the valve, the valve may control charging and discharging of air into and out of the air bags and air mats.

However, when such air sacs and air mats are used, for example a human body, such as the head or the torso, applying a pressing force to such air sacs or air mats, the valve is only allowed to release air and is incapable of inducing counteracting forces of different magnitudes to resist different pressing force acting on the air sacs or air mats (due to such as the weight of the head or the torso). Thus, the supportability (meaning softness/stiffness) and height of the air sacs or air mats are not adjustable to suit personal needs of the users. And, further, variety of products to which the air sacs and air mats may be applied is limited and practical utilizations thereof are poor.

Thus, the existing air sacs and air mats are generally imperfects in respect of the structure and effectiveness thereof.

SUMMARY OF THE INVENTION

An objective of the present invention is to provide a static equilibrium adjusting system that is operable to adjust the supportability (namely softness/stiffness) and height of a bladder by applying "static equilibrium".

Another objective of the present invention is to provide a static equilibrium adjusting method that applies "static equilibrium" to adjust the supportability (namely softness/stiffness) and height of a bladder.

To achieve the above objective, the present invention provides a static equilibrium adjusting system, which comprises: at least one bladder, which has an interior space in which an elastic restoration device is arranged to support an external pressing force; at least one regulation valve, which is in communication with the bladder to provide a reverse-resisting force that is adjustable to resist an air pressure generated, in a direction toward the regulation valve, by the bladder in receiving the external pressing force acting thereon; the external pressing force pressing down the bladder and the elastic restoration device, and through selection among bladders having interior spaces of different sizes and selection among elastic restoration devices of different densities and elastic properties, negative pressure rebounding forces of different magnitudes are generated to cooperate with an equilibrium force generated through setting of adjusting of the regulation valve, so as to provide the bladder with a supporting force of a negative pressure difference to achieve an effect of static equilibrium among the external pressing force, the bladder, and the regulation valve, and the bladder is adjustable for supportability and height and the bladder is automatically positioned and shaped through an effect of negative pressure after the adjusting of the supportability and height.

In the above system, the elastic restoration device comprises one of a foaming material, a foam, rubber, a spring, and an elastic plate.

In the above system, the regulation valve comprises a valve opening, a valve diaphragm, an elastic element, and a push member, wherein the valve opening is arranged in an interior of the regulation valve and in communication with the bladder; the valve diaphragm is positionable in tight engagement with and seals and closes the valve opening; the elastic element is in elastic contact engagement with the valve diaphragm; the push member is arranged at one side of the regulation valve to push the elastic element.

In the above system, the elastic element comprises a spring.

In the above system, the push member is movable threading engagement with the regulation valve.

In the above system, the push member is arranged on the regulation valve in a pushable manner.

In the above system, the bladder is in communication with a self-charging valve, the self-charging valve comprising a plurality of apertures, an airtight sealing element being arranged in an interior of the self-charging valve and between the plurality of apertures, the airtight sealing element being selected as an elastic material, so that the airtight sealing element elastically seals and closes the apertures.

In the above system, a plurality of such bladders are arranged in a lined-up form inside a pillow, the pillow being received in a pillow cover to form a pillow product; wherein a central bladder and two side bladders are independent operating bladders that are not in communication with each other, the central bladder being provided with an air tube in communication with interior and exterior in order to allow air inside of the central space to be discharged at a proper amount when being pressed down.

In the above system, the self-charging valve is provided, in an interior thereof, with a separation board to support an additional airtight sealing element, so that when the bladder carries out air suction for self-charging, the additional airtight sealing element provides an airtight sealing effect for preventing the bladder from sucking in air from the regulation valve and a tube line thereof.

In the above system, a concave surface is arranged on a circumference of the valve opening of the regulation valve, and the valve diaphragm is provided with a convex surface corresponding to the concave surface, so that the concave surface and the convex surface are in matched engagement with each other and a positioning peg is provided on an underside of the valve diaphragm to extend through the valve opening but not blocking and contacting the valve opening.

In the above system, the bladder and the regulation valve are provided in two sets or more than two sets and a box receives and holds the regulation valves.

In the above system, the external pressing force is a force generated by taking the bladder as an acted body, while an acting body actively applies a pressure to the bladder.

In the above system, the external pressing force is an opposite counteracting force that is generated by taking the bladder as acting body moved toward and snugly around an acted body.

In the above system, the bladders are set in a stacked and connected arrangement, a connected site being formed with a passage hole, air inside the bladders of the stacked arrangement being allowed to flow through the passage hole toward each other, so as to increase a support height and when the external pressing force varnishes, the bladders of the stacked arrangement are charged with air simultaneously, and the elastic restoration devices inside the bladders of the stacked arrangement simultaneously generate negative pressure rebounding forces to expand the bladders.

To achieve said another objective, the present invention provides a static equilibrium adjusting method, which comprises:

(a) arranging an elastic restoration device in an interior space of a bladder to support an external pressing force, and setting a regulation valve in communication with the bladder to provide a reverse-resisting force that is adjustable to resist an air pressure generated, in a direction toward the regulation valve, by the bladder upon receiving the external pressing force acting thereon;

(b) allowing the external pressing force to press down the bladder and the elastic restoration device, such that through selection among bladders having interior spaces of different sizes and selection of elastic restoration devices of different densities and elastic properties to generate different negative pressure rebounding forces;

applying an equilibrium force generated through setting of adjusting of the regulation valve to provide the bladder with a supporting force having a negative pressure difference so that an effect of static equilibrium is achieved among the external pressing force, the bladder, and the regulation valve, wherein the bladder is adjustable for supportability and height and the bladder is automatically positioned and shaped through an effect of negative pressure after the adjusting of the supportability and height.

By adopting the above solutions, corresponding to different pressing forces (such as a weight of a human head or torso) that act on an air sac or an air mat, the present invention provides counteraction forces of different magnitudes to resist the pressing force acting on the air sac or air mat, so as to achieve adjustment of supportability (softness/stiffness) and height of the air sac or air mat that suit personal needs, to thereby enhance practical utilization thereof.

DETAILED DESCRIPTION OF THE PREFERRED EMBODIMENT

Figure 1:
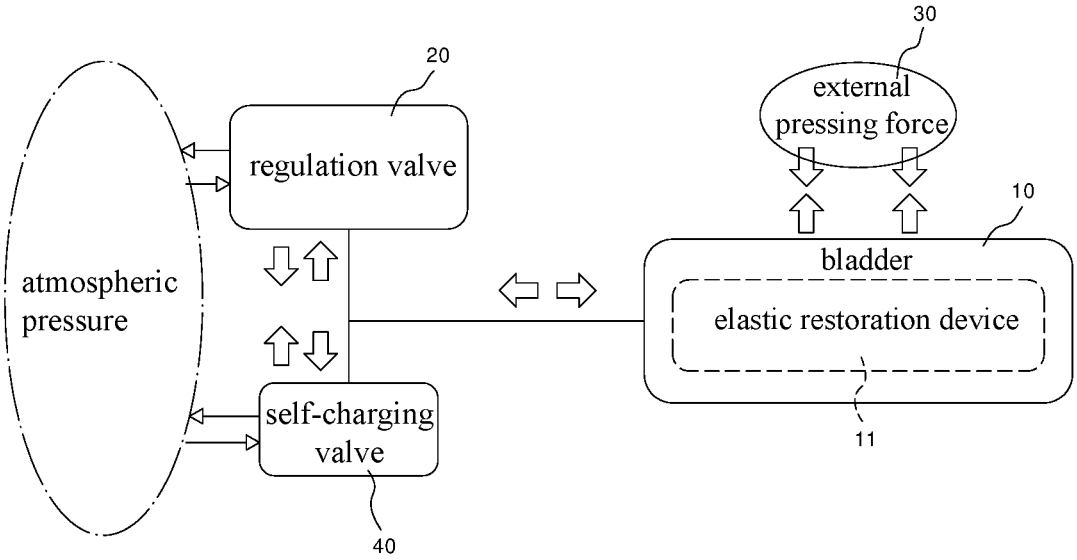
FIG. 1 is a block diagram of a system according to the present invention.

Referring to FIGS. 1, 2, 3, and 4, a static equilibrium adjusting system according to the present invention comprises a bladder 10 and a regulation valve 20. A detailed description will be provided below, in which the bladder 10 has an internal space in which an elastic restoration device 11 is arranged to support an external pressing force 30.

The regulation valve 20 is connected to and in communication with the bladder 10 to provide an adjustable reverse-resisting force to resist an air pressure that is generated, in a direction toward the regulation valve 20, by the bladder 10 upon receiving the external pressing force 30 acting thereon.

In an embodiment, the elastic restoration device 11 comprises one of a foaming material, a foam, rubber, cotton-like material (such as cotton), chemical fiber cotton, for generating a rebounding force.

In an embodiment, the regulation valve 20 comprises a valve opening 21, a valve diaphragm 22, an elastic element 23, and a push member 24, wherein the valve opening 21 is arranged in an interior of the regulation valve 20 and in communication with the bladder 10; the valve diaphragm 22 is positionable in tight engagement with and seals and closes the valve opening 21; the elastic element 23 is in elastic contact engagement with the valve diaphragm 22; and the push member 24 is arranged at one side of the regulation valve 20 to push and press down the elastic element 23.

In an embodiment, the elastic element 23 is selected as a spring.

Figure 3:
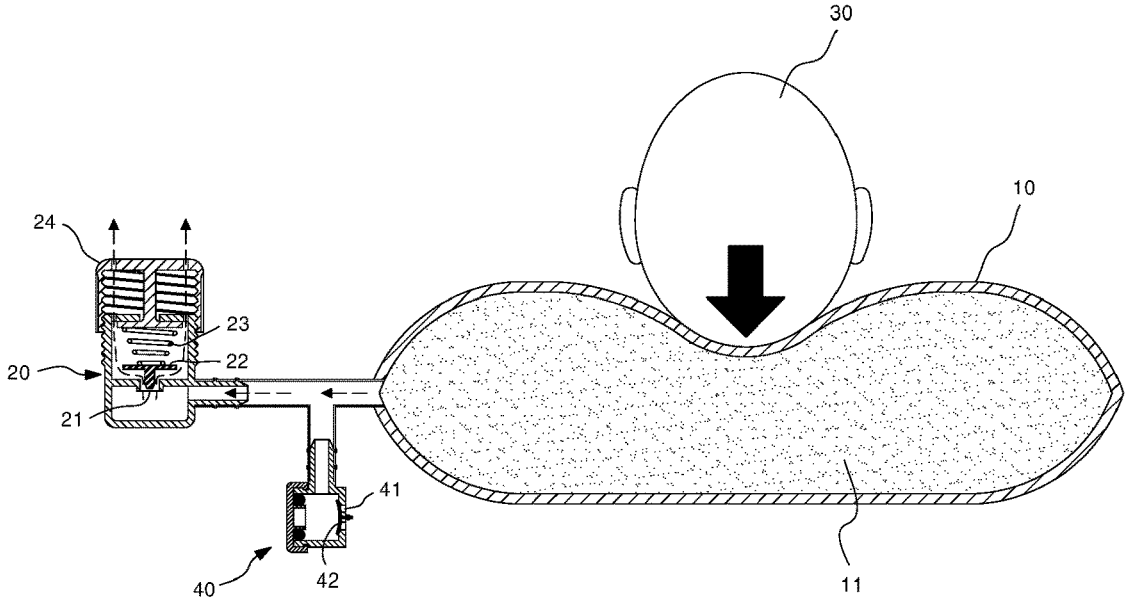
FIGS. 3-5 are schematic views demonstrating an example of operation of the present invention.
Figure 4:
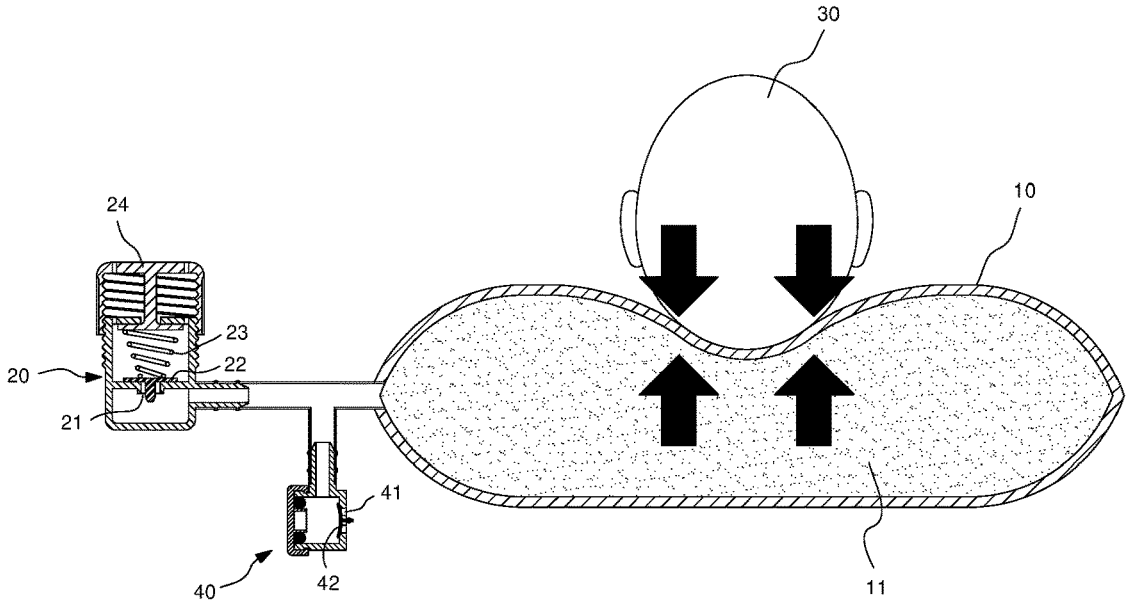

Referring to FIGS. 3 and 4, the external pressing force 30 presses downward the bladder 10 and the elastic restoration device 11, and in the instant embodiment, the external pressing force 30 is a human head pressing down the bladder 10 and the elastic restoration device 11. Through selection among bladders 10 having different sizes of internal space, and selection among of elastic restoration devices 11 having different densities and elastic properties, different negative pressure rebounding force may be generated, which, in combination with a balance force generated through regulation setting of the regulation valve 20, provides the bladder 10 with a supporting force of negative pressure difference, so as to achieve an effect of equilibrium among the external pressing force 30, the bladder 10, and the regulation valve 20, providing the bladder 10 with adjustability of supportability (namely softness/stiffness) and height, and the bladder 10, after adjustment of supportability and height, may automatically position and shape due to negative pressure effect.

When the external pressing force 30 presses down the bladder 10 and the elastic restoration device 11, such as a human head leaning on the bladder 10, the valve opening 21 generates an air pressure pushing open the valve diaphragm 22 to allow a portion of air to release out of the regulation valve 20 through the through opening formed in the regulation valve 20, and then, the elastic element 23 and the valve diaphragm 22 elastically seal and close the valve opening 21 to provide an opposite, corresponding reverse-resisting force to resist the air pressure that the bladder 10 generates, upon receiving the external pressing force 30, in a direction toward the regulation valve 20, to thereby achieve an effect of equilibrium support of the bladder 10.

Figure 2:
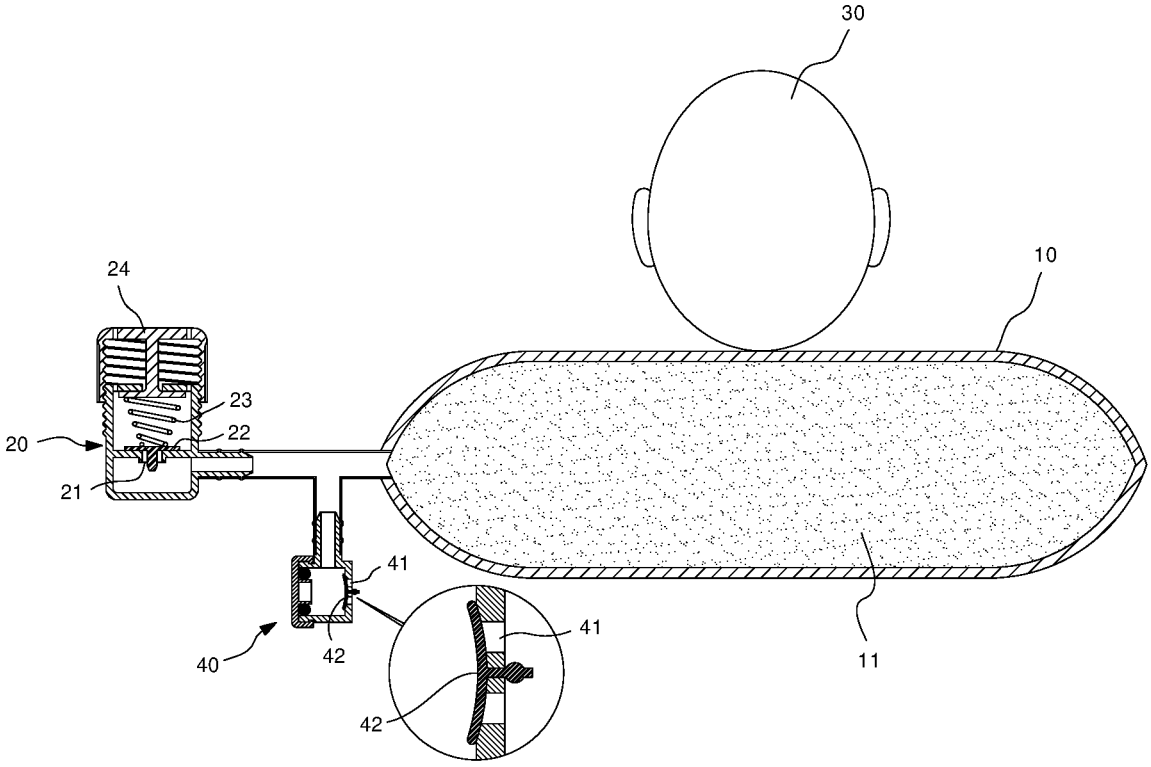
FIG. 2 is a cross-sectional view showing an embodiment according to the present invention.

Referring to FIG. 2, in an embodiment, the bladder 10 is connected to and in communication with a self-charging valve 40. The self-charging valve 40 comprises a plurality of apertures 41, and an airtight sealing element 42 is arranged in the self-charging valve 40 and between the plurality of apertures 41. The airtight sealing element 42 is selected as an elastic material, such that the airtight sealing element 42 elastically seals and closes the apertures 41.

Figure 5:
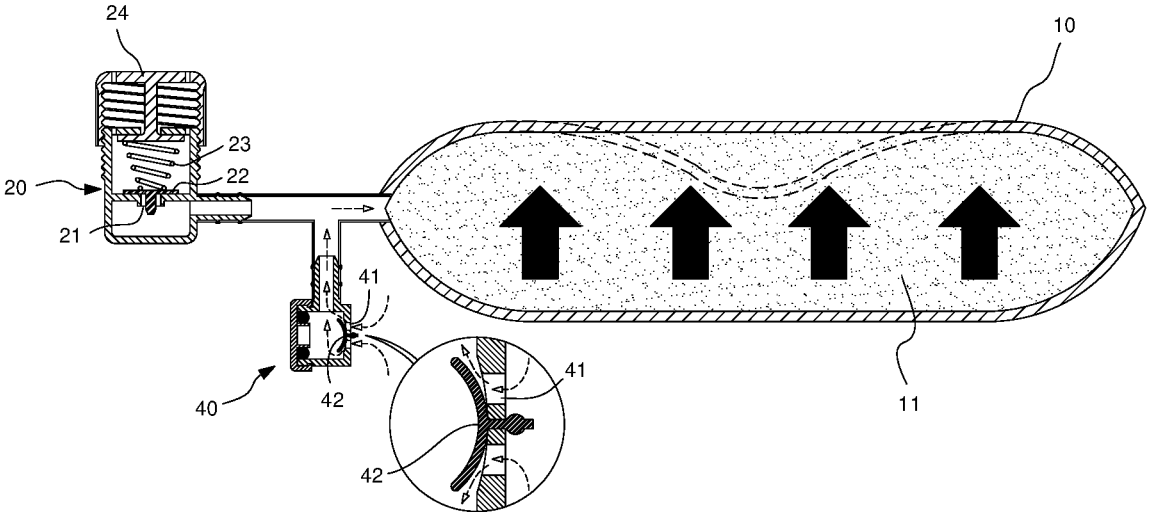

Referring to FIG. 5, in case that the external pressing force 30 is applied to press down the bladder 10 and the elastic restoration device 11 (such as the human head moving away from the bladder 10), the elastic restoration device 11 generates a negative pressure rebounding force to support the bladder 10, and the air pressure of the bladder 10 sucks backwardly the airtight sealing element 42 of the self-charging valve 40, the airtight sealing element 42, due to the effect of backward suction by the air pressure of the bladder 10, elastically deforms to automatically open the apertures 41 to drawn external air through the apertures 41 into the self-charging valve 40 and then reaching into the bladder 10, so as to automatically recharge air into the bladder 10 for restoration of an original shape thereof, thereby avoiding deformation of the elastic restoration device 11 resulting from elastic fatigue thereof.

In a next use of the bladder 10, the height of the bladder 10 follows the reverse-resisting force adjusted and set by the regulation valve 20 to generate a static equilibrium effect, maintained at a memorized keeping state for being high/low or soft/stiff.

Figure 6:
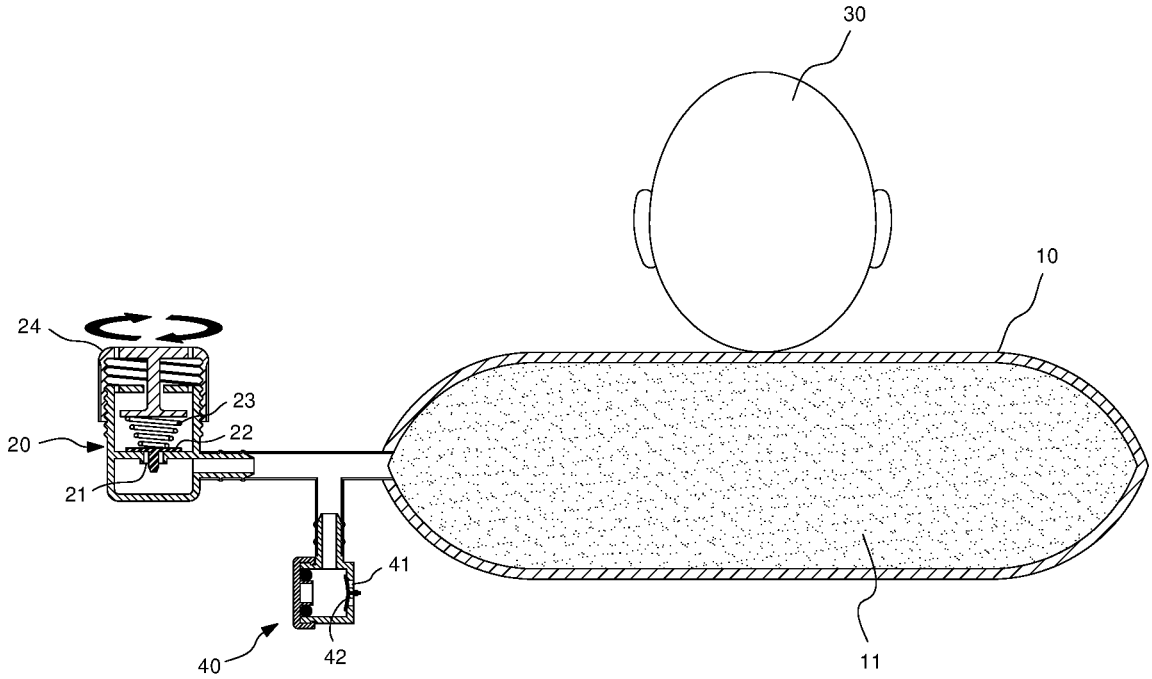
FIGS. 6 and 7 are schematic views demonstrating displacements of different extents achieved with rotation-induced pushes according to the present invention so as to push an elastic element to generate different extents of deformation.
Figure 7:
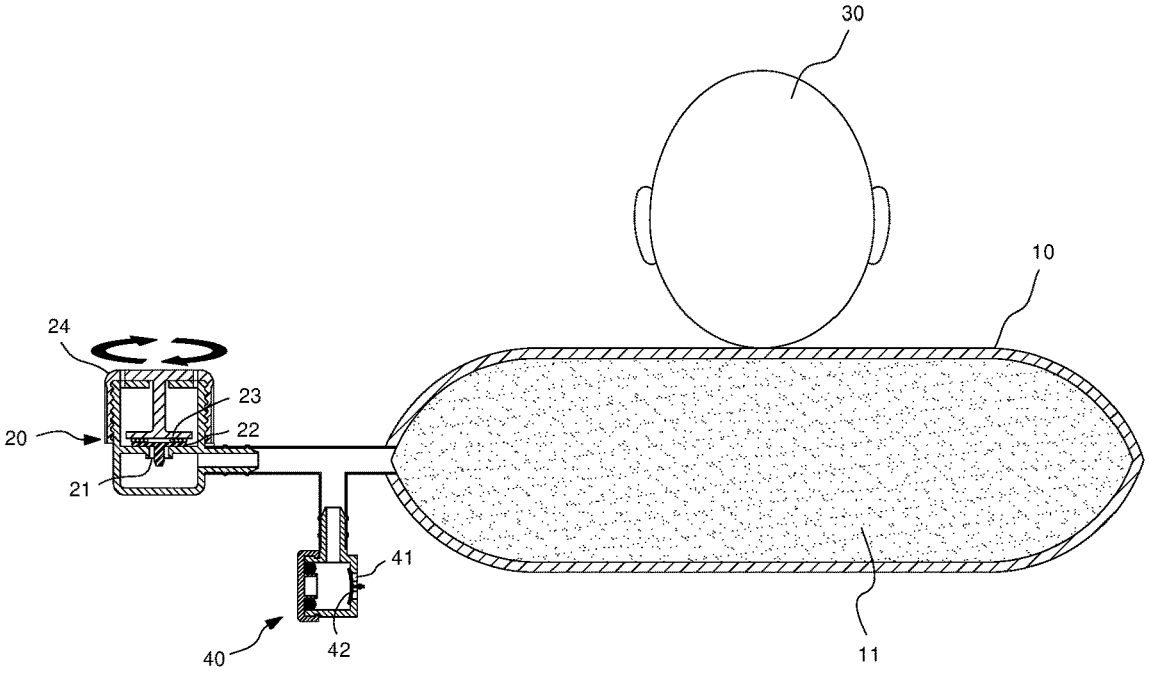

Referring to FIGS. 6 and 7, in an embodiment, the push member 24 is in movable threading engagement with the regulation valve 20.

By rotating the push member 24 to induce movements of different extents for pushing the elastic element 23 to generate different degrees of deformation, the valve diaphragm 22 is made to induce reverse-resisting forces of different magnitudes for resisting the air pressure of the bladder 10 to achieve an effect of adjusting the supportability and height of the bladder 10 based on personal needs, meaning the extent of softness/stiffness of the bladder 10 can be adjusted.

Further, after the adjustment of the supportability and height, the bladder 10 may automatically position and shape based on an effect of negative pressure. For example, when a human head lies on the bladder 10, in addition to the adjustment of the supportability and height of the bladder 10 based on personal needs, the automatic positioning and shaping of the bladder 10 makes it more snugly around the human head to enhance comfortability.

Figure 8:
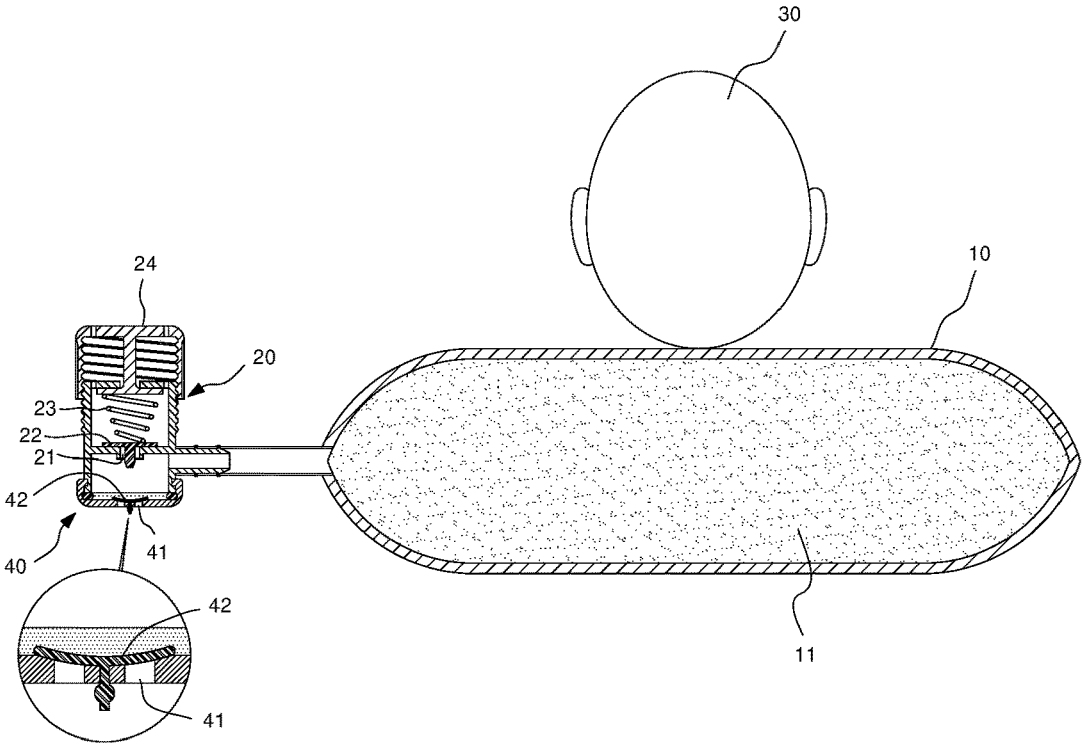
FIG. 8 is a cross-sectional view illustrating a regulation valve and a self-charging valve being integrated as a one-piece structure according to the present invention.

Referring to FIG. 8, in an embodiment, the regulation valve 20 and the self-charging valve 40 are integrated and combined as a one-piece structure.

Figure 9:
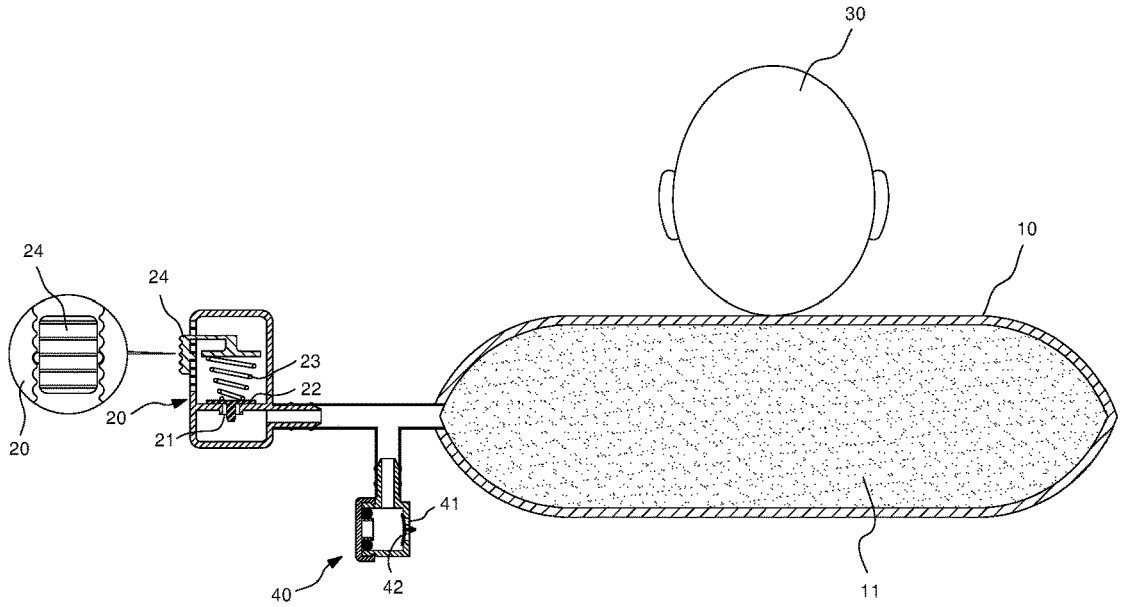
FIG. 9 is a cross-sectional view showing a structure according to a second embodiment of the present invention.

Referring to FIG. 9, in an embodiment, the push member 24 is arranged on the regulation valve 20 in a pushable manner.

Through pushing and moving the push member 24 to achieve displacements of different extents the elastic element 23 is pressed to generate different degrees of deformation, so that the valve diaphragm 22 may resist the air pressure of the bladder 10 with reverse-resisting forces of different magnitudes.

At the contact site between the regulation valve 20 and the push member 24, a wavy and ridge-like corrugation engagement structure may be arranged for automatic positioning of the push member 24 after the displacement.

Figure 10:
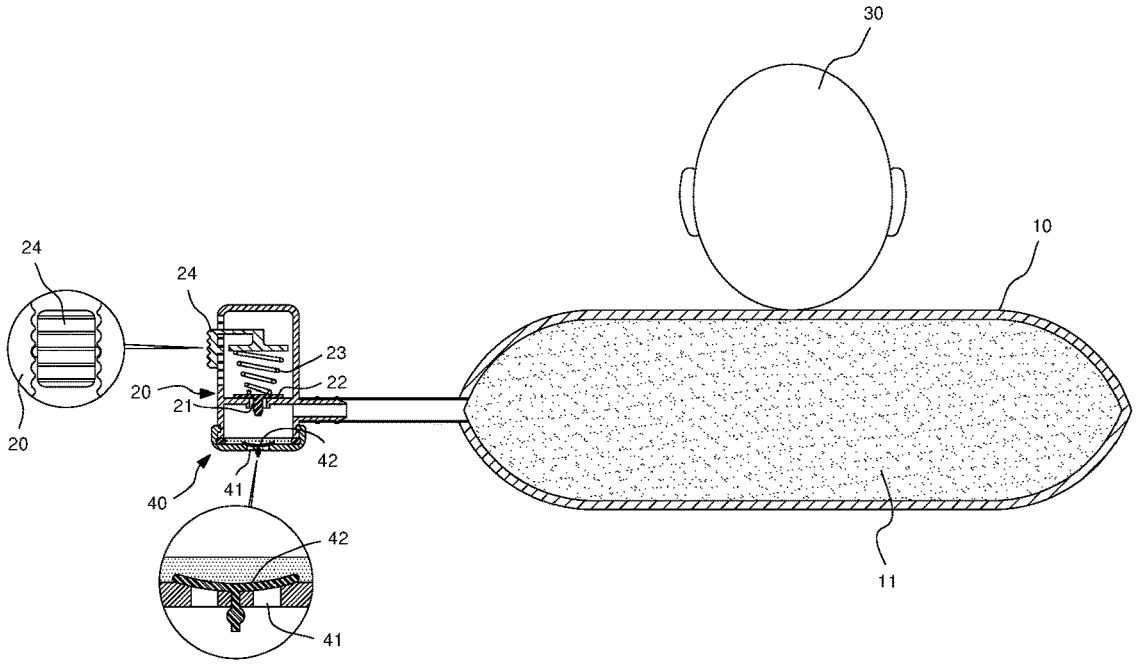
FIG. 10 is a cross-sectional view showing a structure according to a third embodiment of the present invention.

Referring to FIG. 10, in an embodiment, the regulation valve 20 that is provided with the pushable push member 24 is integrated and combined with the self-charging valve 40 as a one-piece structure.

Figure 11:
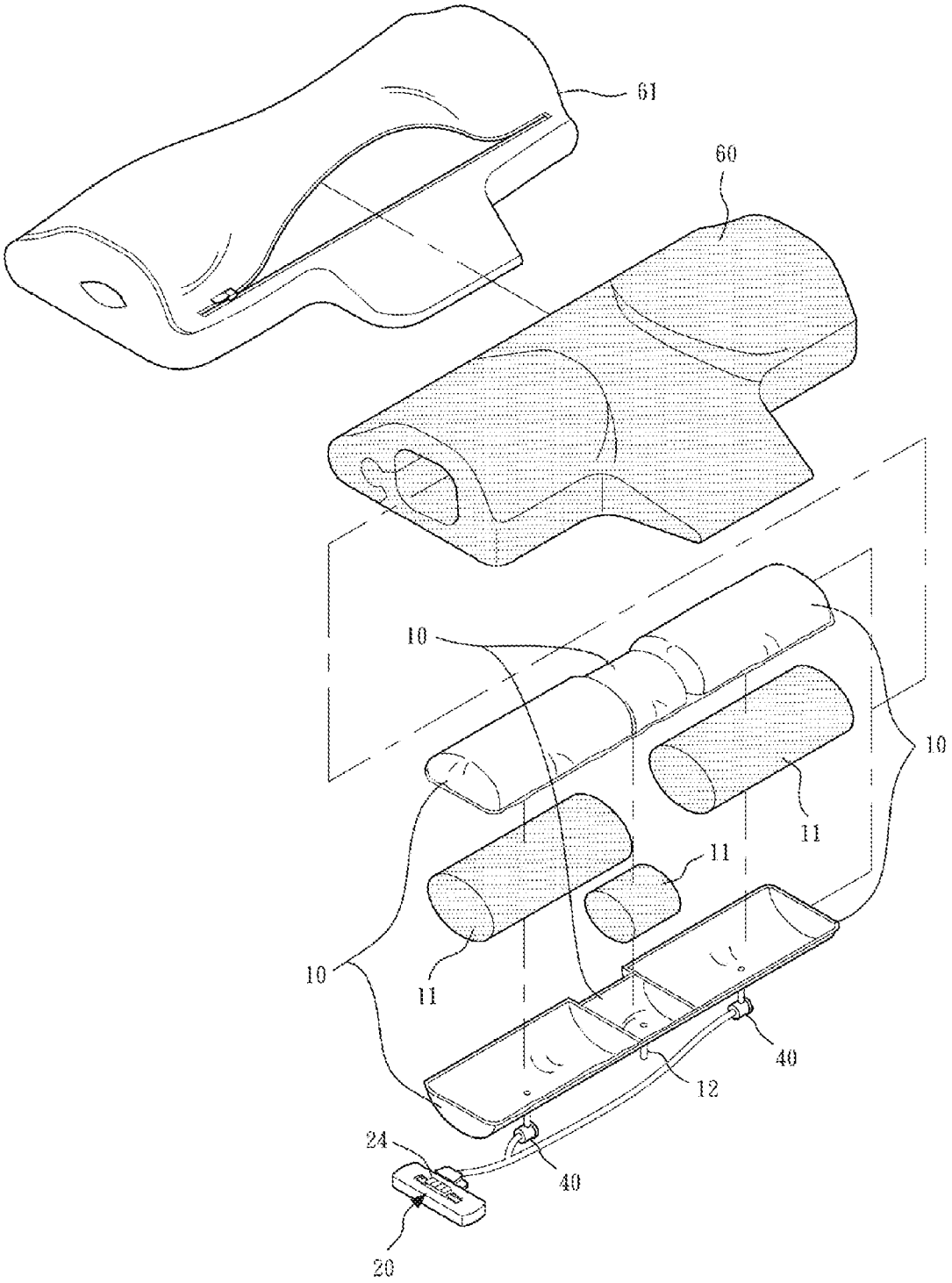
FIG. 11 is an exploded view showing a structure according to a fourth embodiment of the present invention.
Figure 12:
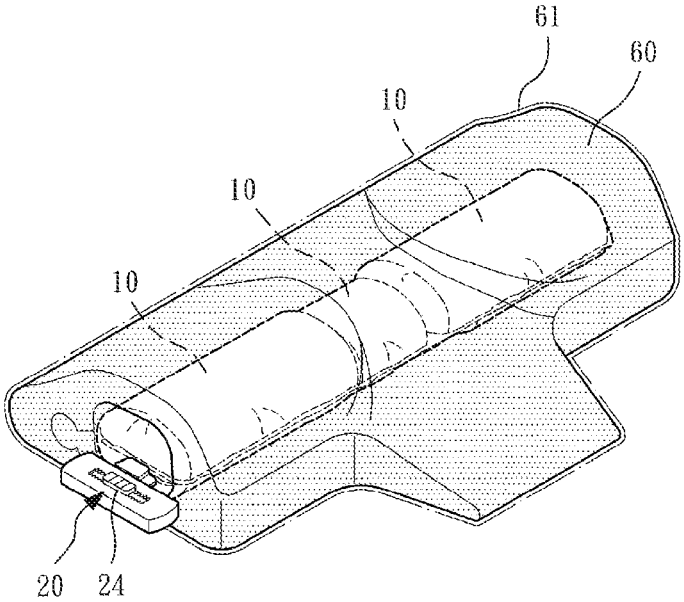
FIG. 12 is a perspective view showing the structure according to the fourth embodiment of the present invention.

Referring to FIGS. 11 and 12, in an embodiment, three of such as bladder 10 are arranged in a lined-up manner and set inside a pillow 60, and the pillow 60 is disposed inside a pillow cover 61 to form a pillow product.

In such an arrangement, a central bladder 10 and two side bladders 10 are not in communication with each other and acts as individual and independent bladders. The central bladder 10 is provided with an air tube 12 for communication between interior and exterior thereof, so that when the central space 12 is depressed down, interior air can be discharged with a proper amount.

As such, when a human head lies on the pillow 60, a center-low and two-side-high condition may be presented to be snugger, supporting, and stabilizing the head, meeting human head ergonomics and enhancing stress relief effect.

Further, the regulation valve 20 is in communication with two independent bladders 10, and each of the independent bladders 10 is individually provided with an independent self-charging valve 40.

As such, such a structure is applicable to a pillow and, in the pillow, a plurality of static equilibrium adjusting zones that are each independent of each other are formed. Each one of the independent bladders 10 is of an independent operation for regulation with the regulation valve 20. Air flowing inside each of the independent bladders 10 is not affecting each other. In other words, the pillow may exhibit an effect of adjusting only at the zone that is pressed by the human head, while the other zones that are not in contact with the human head are not showing any effect of adjusting. As such, preciseness of adjustment of each independent one of the bladders 10 is enhanced, and the snugness and comfortability of the pillow are also enhanced.

Figure 13:
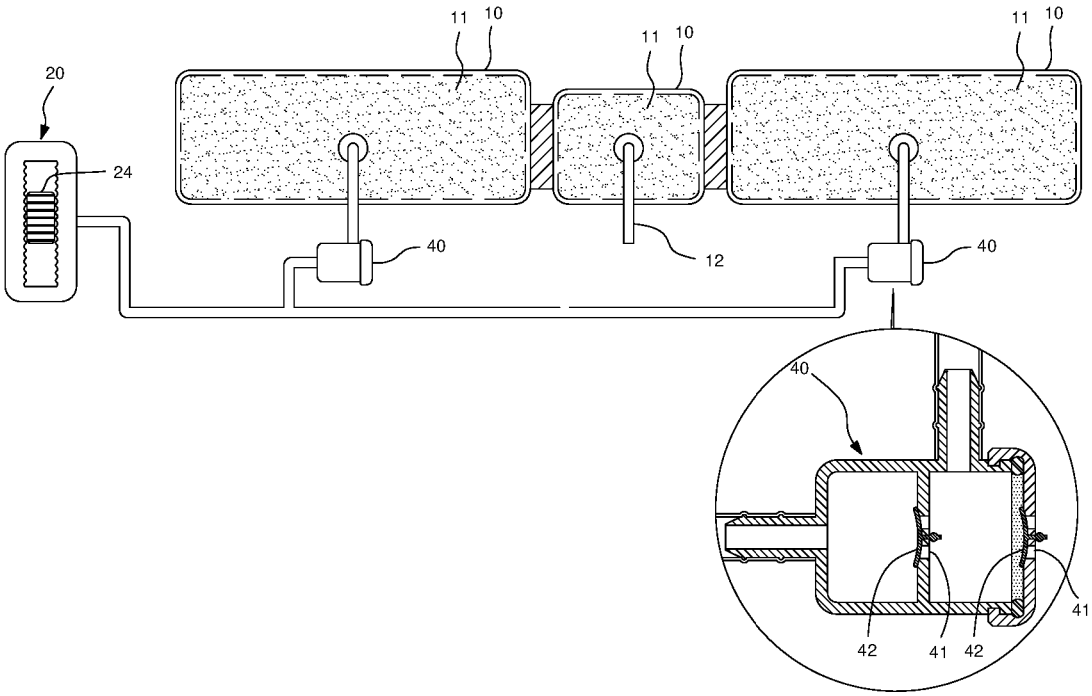
FIG. 13 is a cross-sectional view showing another structure of the self-charging valve according to the present invention

Referring to FIG. 13, in an embodiment, the self-charging valve 40 is provided, in an interior thereof, with a separation board for supporting an additional airtight sealing element 42, so that when the bladder 10 sucks in air for self-charging, the additional airtight sealing element 42 provides an airtight sealing effect by which the bladder 10 does not suck in gases from the regulation valve 20 and tube lines thereof, so that the sucked-in self-charging air flow of the bladder 10 is more stable and the adjustment of the bladder 10 is made more stable.

Figure 14:
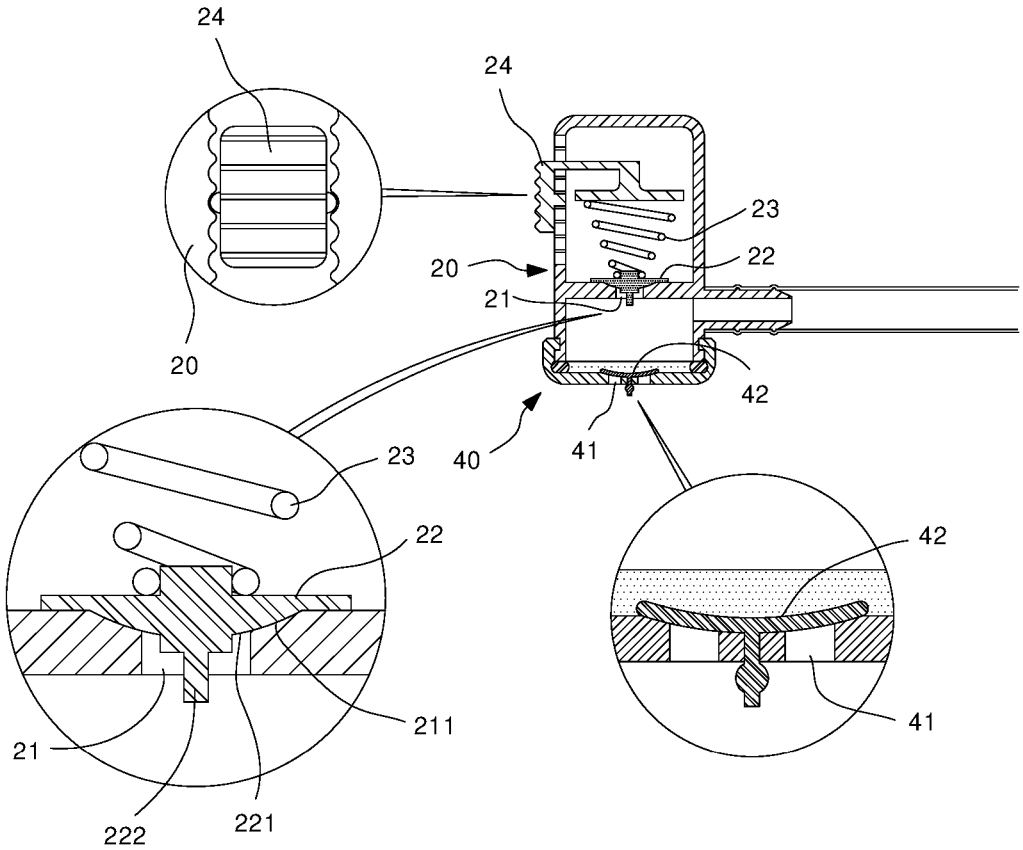
FIG. 14 is a cross-sectional view showing another structure of the regulation valve according to the present invention

Referring to FIG. 14, in an embodiment, a concave surface 211 is formed on a circumference of the valve opening 21 of the regulation valve 20, and the valve diaphragm 22 is provided with a convex surface 221 corresponding to the concave surface 211, and the concave surface 211 and the convex surface 221 match each other to increase a contact area therebetween and to improve positionability. A positioning peg 222 is provided on an underside of the valve diaphragm 22 to extend through the valve opening 21 but not blocking and contacting the valve opening 21, so as to make the valve diaphragm 22 not readily move to a position separating from the valve opening 21.

As such, either in a condition of closing the valve opening 21 or in a condition of being pushed by an air pressure to open the valve opening 21, the valve diaphragm 22 can be retained on and positioned at the valve opening 21 to enhance the preciseness of opening and closing of the valve opening 21 by the valve diaphragm 22.

Figure 15:
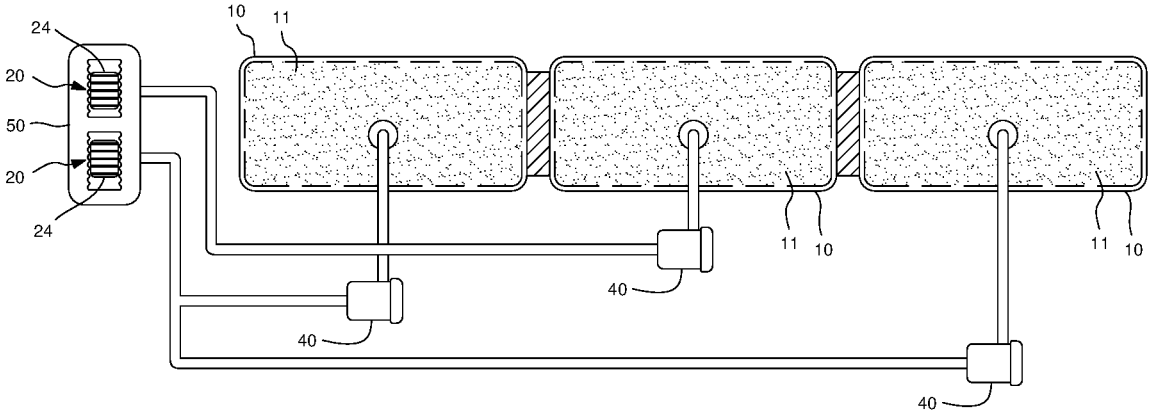
FIG. 15 is an exploded view showing a structure according to a fifth embodiment of the present invention.
Figure 16:
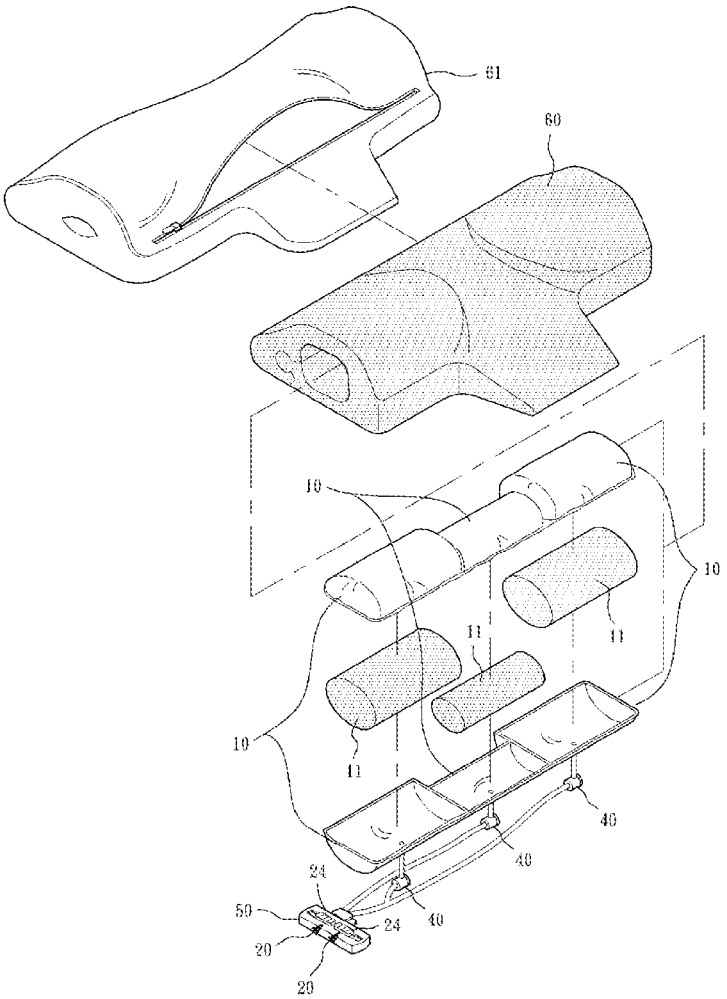
FIG. 16 is a perspective view showing the structure according to the fifth embodiment of the present invention.
Figure 17:
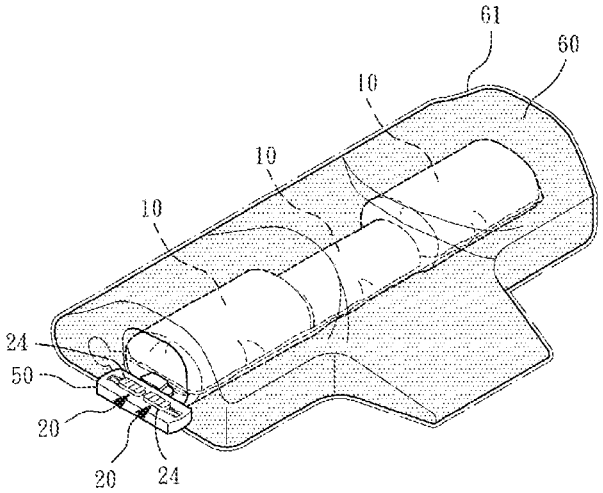
FIG. 17 is a schematic view showing an arrangement of a bladder, a regulation valve, and a self-charging valve of the structure according to the fifth embodiment of the present invention.

Referring to FIGS. 15, 16, and 17, in an embodiment, two or more than two sets of bladder 10 and regulation valve 20 are provided, and a box 50 is provided to receive and hold such regulation valves 20 to achieve an aesthetic effect.

The present invention comprises two regulation valves 20, wherein one of the regulation valves 20 is set in communication with two independent bladders 10 and two independent self-charging valves 40, two bladders 10 being arranged at two sides, wherein another one of the regulation valves 20 is in communication with one independent bladder 10 and one independent self-charging valve 40, the bladder 10 being arranged at the center.

As such, different ones of the regulation valves 20 are operable to individually control independent ones of the bladders 10 for application to a pillow product, so that when a human head lies thereon, each of the bladders 10, based on a pressing force acting thereon, may individually adjust the supportability (namely softness/stiffness) and height to enhance preciseness of adjustment of the bladder 10, and the snugness and comfortability of the pillow are also enhanced.

Figure 18:
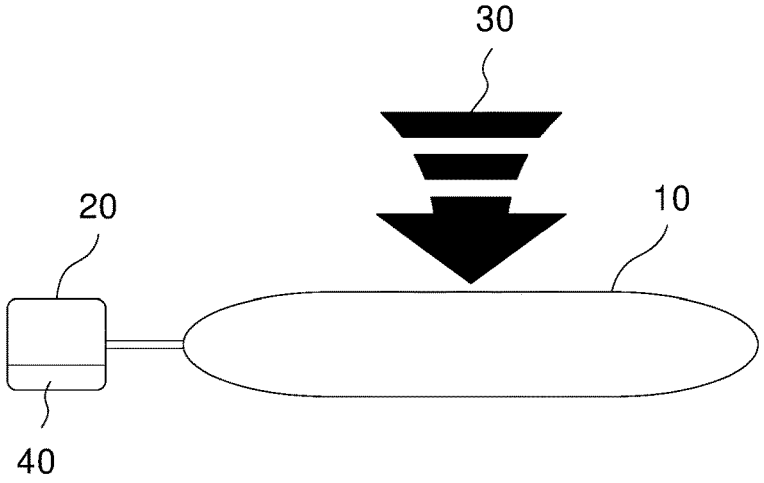
FIG. 18 is a schematic view illustrating an example of use of an external pressing force according to the present invention.

Referring to FIG. 18, in an embodiment, the external pressing force 30 is force that is generated by taking the bladder 10 as an acted body, while an acting body, such as a human body, actively applies a pressure to the bladder 10, such as the bladder 10 being applied to a chair, a pillow, a mat that are structured for a human body to lie thereon.

Figure 19:
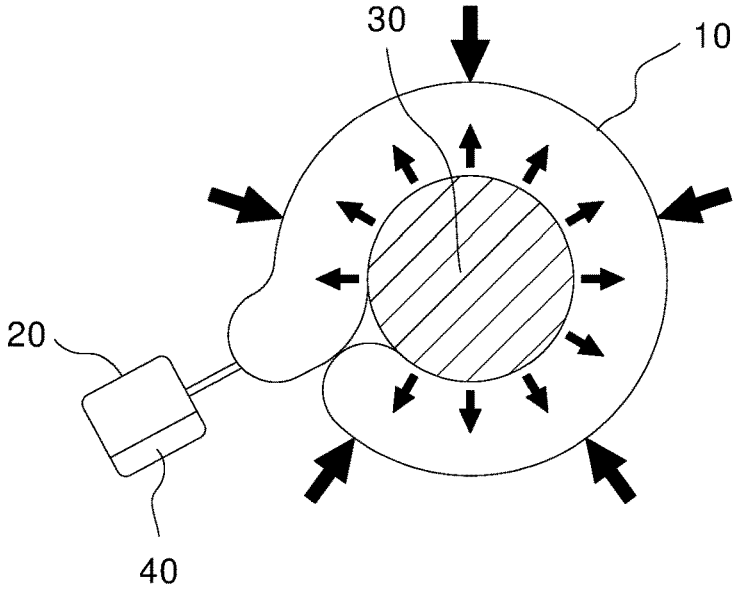
FIG. 19 is another schematic view illustrating an example of use of an external pressing force according to the present invention.

Referring to FIG. 19, in an embodiment, the external pressing force 30 is counteracting force that is generated by taking the bladder 10 as an acting body that is moved toward and snugly around an acted body, such as a human body, such as the bladder 10 being applied to various products, such as a neck protector (cover) and a knee sleeve, for being sleeve on human torsos and organs.

Figure 20:
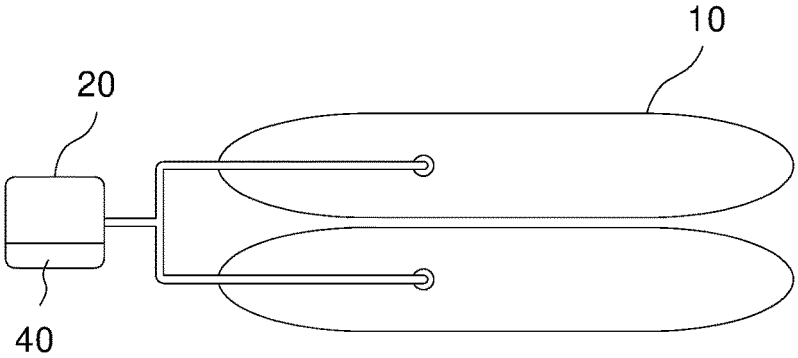
FIG. 20 is a schematic view illustrating a stacked arrangement of bladders according to the present invention.

Referring to FIG. 20, in an embodiment, the bladders 10 are set in a stacked arrangement, and each of the bladders 10 is in communication with the regulation valve 20 in order to increase a support height and when the external pressing force 30 vanishes, the bladders 10 of the stacked arrangement can be charged with air simultaneously, and the elastic restoration devices 11 inside the bladders 10 of the stacked arrangement simultaneously generate negative pressure rebounding forces to expand the bladders 10 for increasing the speed of restoration back to the original height and shape.

Figure 21:
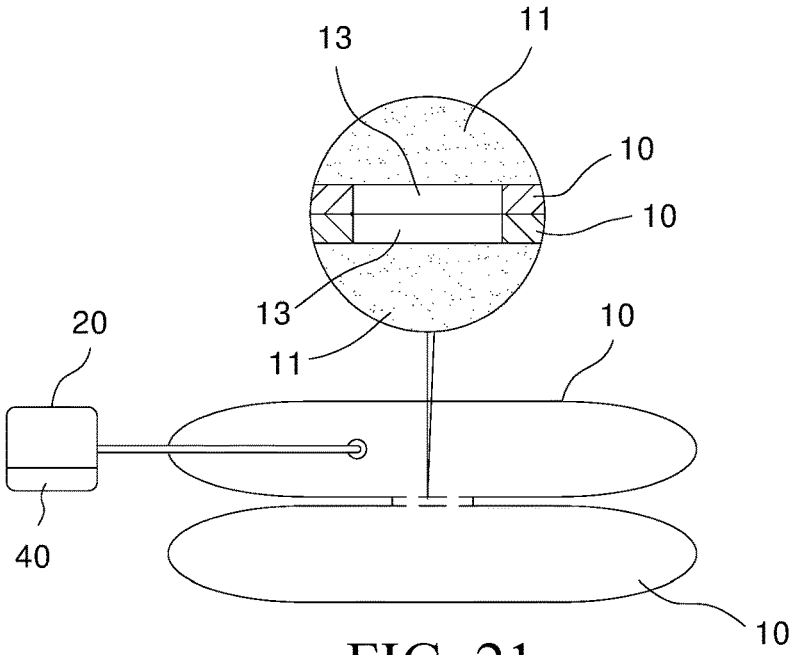
FIG. 21 is a schematic view illustrating a stacked and connected arrangement of bladders according to the present invention.

Referring to FIG. 21, in an embodiment, the bladders 10 are set in a stacked and connected arrangement, and the connection site may have an airtight sealing by means of techniques of hot pressing or hot melting. The connected site is provided with a passage hole 13, and air inside the bladders 10 of the stacked arrangement may flow toward each other through the passage hole 13, so that the supporting height can be increased and when the external pressing force 30 vanishes, the bladders 10 of the stacked arrangement can be charged with air simultaneously, and the elastic restoration devices 11 inside the bladders 10 of the stacked arrangement simultaneously generate negative pressure rebounding forces to expand the bladders 10 for increasing the speed of restoration back to the original height and shape.

Figure 22:
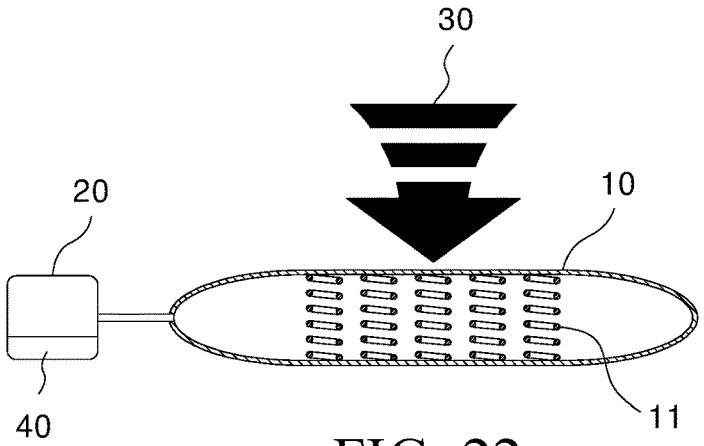
FIG. 22 is a schematic view showing an example of another structure of an elastic restoration device according to the present invention.

Referring to FIG. 22, in an embodiment, the elastic restoration device 11 is a spring to generate a rebounding force.

Figure 23:
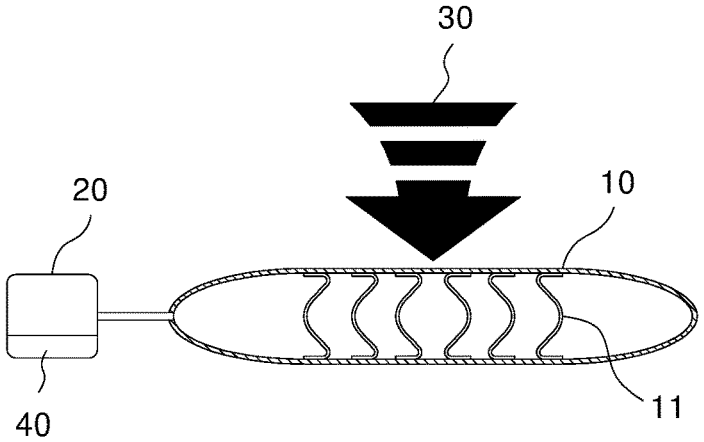
FIG. 23 is a schematic view showing an example of a further structure of an elastic restoration device according to the present invention.

Referring to FIG. 23, in an embodiment, the elastic restoration device 11 is an elastic plate to generate a rebounding force.

Referring to FIG. 1, the present invention provides a static equilibrium adjusting method, which comprises: (a) arranging an elastic restoration device 11 in an interior space of a bladder 10 to support an external pressing force, and setting a regulation valve 20 in communication with the bladder 10 to provide a reverse-resisting force that is adjustable to resist an air pressure generated, in a direction toward the regulation valve 20, by the bladder 10 upon receiving the external pressing force 30 acting thereon; (b) allowing the external pressing force 30 to press down the bladder 10 and the elastic restoration device 11, such that through selection among bladders 10 having interior spaces of different sizes and selection of elastic restoration devices 11 of different densities and elastic properties to generate different negative pressure rebounding forces; (c) applying an equilibrium force generated through setting of adjusting of the regulation valve 20 to provide the bladder 10 with a supporting force having a negative pressure difference so that an effect of static equilibrium is achieved among the external pressing force 30, the bladder 10, and the regulation valve 20, wherein the bladder 10 is adjustable for supportability and height and the bladder 10 is automatically positioned and shaped through an effect of negative pressure after the adjusting of the supportability and height.

I claim:

1. A static equilibrium adjusting system, comprising: at least one bladder, which has an interior space in which an elastic restoration device is arranged to support an external pressing force; at least one regulation valve, which is in communication with the bladder to provide a reverse-resisting force that is adjustable to resist an air pressure generated, in a direction toward the regulation valve, by the bladder in receiving the external pressing force acting thereon; the external pressing force pressing down the bladder and the elastic restoration device, and through selection among bladders having interior spaces of different sizes and selection among elastic restoration devices of different densities and elastic properties, negative pressure rebounding forces of different magnitudes are generated to cooperate with the reverse-resisting force generated through setting of adjusting of the regulation valve, so as to provide the bladder with a supporting force of a negative pressure difference to achieve an effect of static equilibrium among the external pressing force, the bladder, and the regulation valve, and the bladder is adjustable for supportability and height and the bladder is automatically positioned and shaped through an effect of negative pressure after the adjusting of the supportability and height, wherein the regulation valve comprises a valve opening, a valve diaphragm, an elastic element, and a push member, wherein the valve opening is arranged in an interior of the regulation valve and in communication with the bladder; the valve diaphragm is positionable in tight engagement with and seals and closes the valve opening; the elastic element is in elastic contact engagement with the valve diaphragm; the push member is arranged on the regulation valve in a pushable manner to selectively compress the elastic element, wherein the push member is movable relative to the regulation valve to selectively set and fix displacement of the push member relative to the regulation valve at different extents so as to set the elastic member at different states of deformation, including a fully compressed state at which the elastic element is fully compressed between the valve diaphragm and the push member so as to have the valve opening securely closed by the valve diaphragm and the valve diaphragm immobile relative to the valve opening;

wherein the bladder is in communication with a self-charging valve, the self-charging valve comprising a plurality of apertures, an airtight sealing element being arranged in an interior of the self-charging valve and between the plurality of apertures, the airtight sealing element being selected as an elastic material, so that the airtight sealing element elastically seals and closes the apertures; and wherein the self-charging valve is provided, in an interior thereof, with a separation board to support an additional airtight sealing element, so that when the bladder carries out air suction for self-charging, the additional airtight sealing element provides an airtight sealing effect for preventing the bladder from sucking in air from the regulation valve and a tube line thereof; and wherein a concave surface is arranged on a circumference of the valve opening of the regulation valve, and the valve diaphragm is provided with a convex surface corresponding to the concave surface, so that the concave surface and the convex surface are in matched engagement with each other and a positioning peg is provided on an underside of the valve diaphragm to extend through the valve opening but not blocking and contacting the valve opening.

2. The static equilibrium adjusting system according to claim 1, wherein the elastic restoration device comprises one of a foaming material, a foam, rubber, a spring, and an elastic plate.

3. The static equilibrium adjusting system according to claim 1, wherein the elastic element comprises a spring.

4. The static equilibrium adjusting system according to claim 1, wherein the at least one bladder comprises a plurality of bladders arranged in a lined-up form inside a pillow, the pillow being received in a pillow cover to form a pillow product; wherein a central bladder and two side bladders are independent operating bladders that are not in communication with each other, the central bladder being provided with an air tube in communication with interior and exterior in order to allow air inside of the central space to be discharged at a proper amount when being pressed down.

5. The static equilibrium adjusting system according to claim 1, wherein the at least one bladder and the at least one regulation valve are arranged in two sets or more than two sets and a box receives and holds the regulation valves.

6. The static equilibrium adjusting system according to claim 1, wherein the external pressing force is a force generated by taking the bladder as an acted body, while an acting body actively applies a pressure to the bladder.

7. The static equilibrium adjusting system according to claim 1, wherein the external pressing force is an opposite counteracting force that is generated by taking the bladder as acting body moved toward and snugly around an acted body.

8. The static equilibrium adjusting system according to claim 1, wherein the at least one bladder comprises bladders set in a stacked and connected arrangement, a connected site being formed with a passage hole, air inside the bladders of the stacked arrangement being allowed to flow through the passage hole toward each other, so as to increase a support height and when the external pressing force vanishes, the bladders of the stacked arrangement are charged with air simultaneously, and the elastic restoration devices inside the bladders of the stacked arrangement simultaneously generate negative pressure rebounding forces to expand the bladders.

* * * * *